US006871032B2

(12) United States Patent
Iida

(10) Patent No.: US 6,871,032 B2
(45) Date of Patent: Mar. 22, 2005

(54) IMAGE FORMING APPARATUS AND MEDIUM FEEDING DEVICE WITH SWINGING MEMBER HAVING MEDIUM DETECTION SECTION

(75) Inventor: Yujiro Iida, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/642,616

(22) Filed: Aug. 19, 2003

(65) Prior Publication Data

US 2004/0037588 A1 Feb. 26, 2004

(30) Foreign Application Priority Data

Aug. 20, 2002 (JP) ..... 2002-239187

(51) Int. Cl.[7] ..... G03G 21/00
(52) U.S. Cl. ..... 399/124
(58) Field of Search ..... 399/124, 110, 399/372

(56) References Cited

U.S. PATENT DOCUMENTS 5,255,061 A * 10/1993 Matsuura et al. ..... 399/124
5,280,331 A * 1/1994 Namiki ..... 399/124

FOREIGN PATENT DOCUMENTS

JP 63244059 A * 10/1988 ..... G03G/15/00

* cited by examiner

*Primary Examiner*—Quana Grainger
(74) *Attorney, Agent, or Firm*—Takeuchi & Takeuchi

(57) ABSTRACT

A main body the image forming apparatus comprises a swinging member which swings freely with respect to the main body. The swinging member is provided with a feeding member for transporting a medium which is fed from a medium feed section rotatably supported by the swinging member. When swinging the swinging member, the user can access the medium feed section for removing the jammed medium. The feeding member is not deteriorated over ages. It is easy to take out a belt unit for transporting the medium when the swinging member is opened.

22 Claims, 16 Drawing Sheets

IMAGE FORMING APPARATUS AND MEDIUM FEEDING DEVICE WITH SWINGING MEMBER HAVING MEDIUM DETECTION SECTION

BACKGROUND OF THE INVENTION

1. Field of the Invention

The present invention relates to an image forming apparatus and a medium feeding device.

2. Description of the Related Art

An image forming apparatus, such as a printer, a copying machine, and a facsimile machine, comprises a feeder unit as a means for absorbing a medium. The medium, such as paper or OHP sheets, accommodated in a medium cassette, is separated and fed one by one by a hopping roller. The fed medium abuts against a resist roller and a pressure roller so that the skew thereof is corrected. The medium is fed by the resist roller to an image forming section with an image drum and a transfer section. Also, the medium is fed to an image processing section having a read-out portion for reading out an image.

In order to create an accurate image, the transfer section and the resist roller are maintained in parallel with each other to keep the position of the image to be formed by the image forming apparatus. It is so important to maintain the parallelism between the transfer section and the resist roller that the feeder unit is made integral with and fixed to a main body of the apparatus.

When the medium is jammed during transportation, it must be removed. Accordingly, a cover of the main body is provided such that it can be opened and closed freely. If a medium is jammed, the user opens the cover and removes the medium to clear the jam.

However, when the user takes out the medium toward the user, it gives a reverse revolution force to the resist and pressure rollers. The medium may be torn by the load when taken out.

One of the resist and pressure rollers is disposed on a side of the cover and the other is disposed on a side of the main body. In this case, however, the resist and pressure rollers are separate when the cover is opened. Although the medium is easily removed to the side of the user, the resist and pressure rollers are separated by the open/close operation of the cover so that the pressure between the resist and pressure rollers is changed over years. Consequently, the medium is not fed in a stable condition afterwards. Also, a belt unit is provided for feeding the medium to the image forming section. However, the belt unit cannot be taken out to this side (user's side) easily because one of the resist and pressure rollers is disposed on the side of the main body.

In addition, when the user takes out the medium to this side, it provides a sensor lever constituting a medium detection sensor with a force in a direction opposite to a feeding direction of the medium. Consequently, the sensor lever becomes so rickety that the detection accuracy of the medium detection sensor is reduced.

SUMMARY OF THE INVENTION

Accordingly, it is an object of the present invention to provide an image forming apparatus which permits easy removal of a jammed medium when the medium fed from a medium feeding section is jammed.

It is another object of the present invention to provide an image forming apparatus which allows a belt unit to be taken out from the front side of the apparatus so that the medium on the belt unit is easily removed.

It is still another object of the present invention to provide an image forming apparatus which permits smooth open/close operation of a feeder unit without using an expensive device such as a damper.

DESCRIPTION OF THE PREFERRED EMBODIMENT

An image forming apparatus, such as a printer, copying machine, or facsimile machine, and a medium feeding device for the image forming apparatus according to embodiments of the present invention will now be described with respect to the accompanying drawings. The medium feeding device may be used for a scanner, too.

Figure 1:
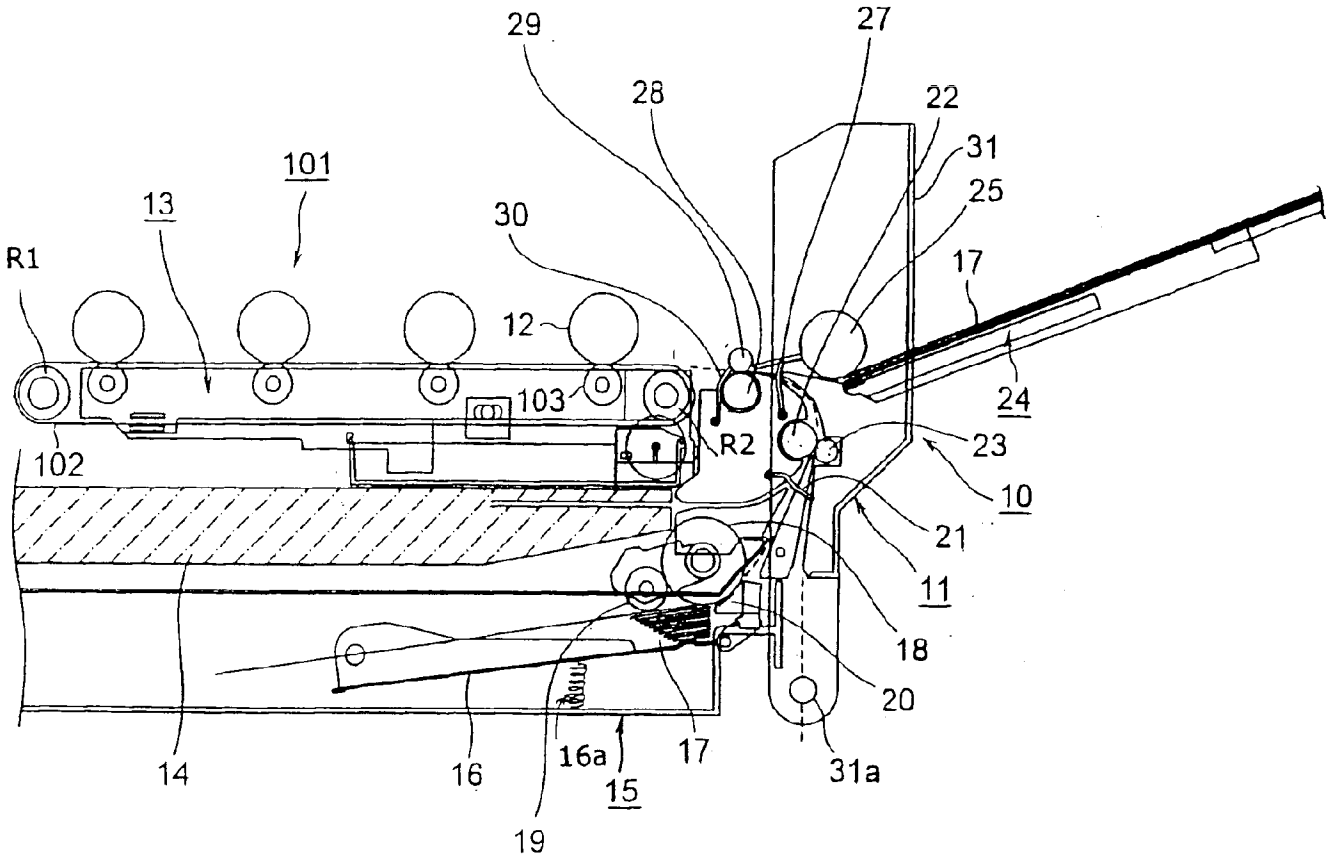
FIGS. 1–2 are side views of an image forming apparatus according to the first embodiment of the present invention, showing a major part of the image forming apparatus.
Figure 2:
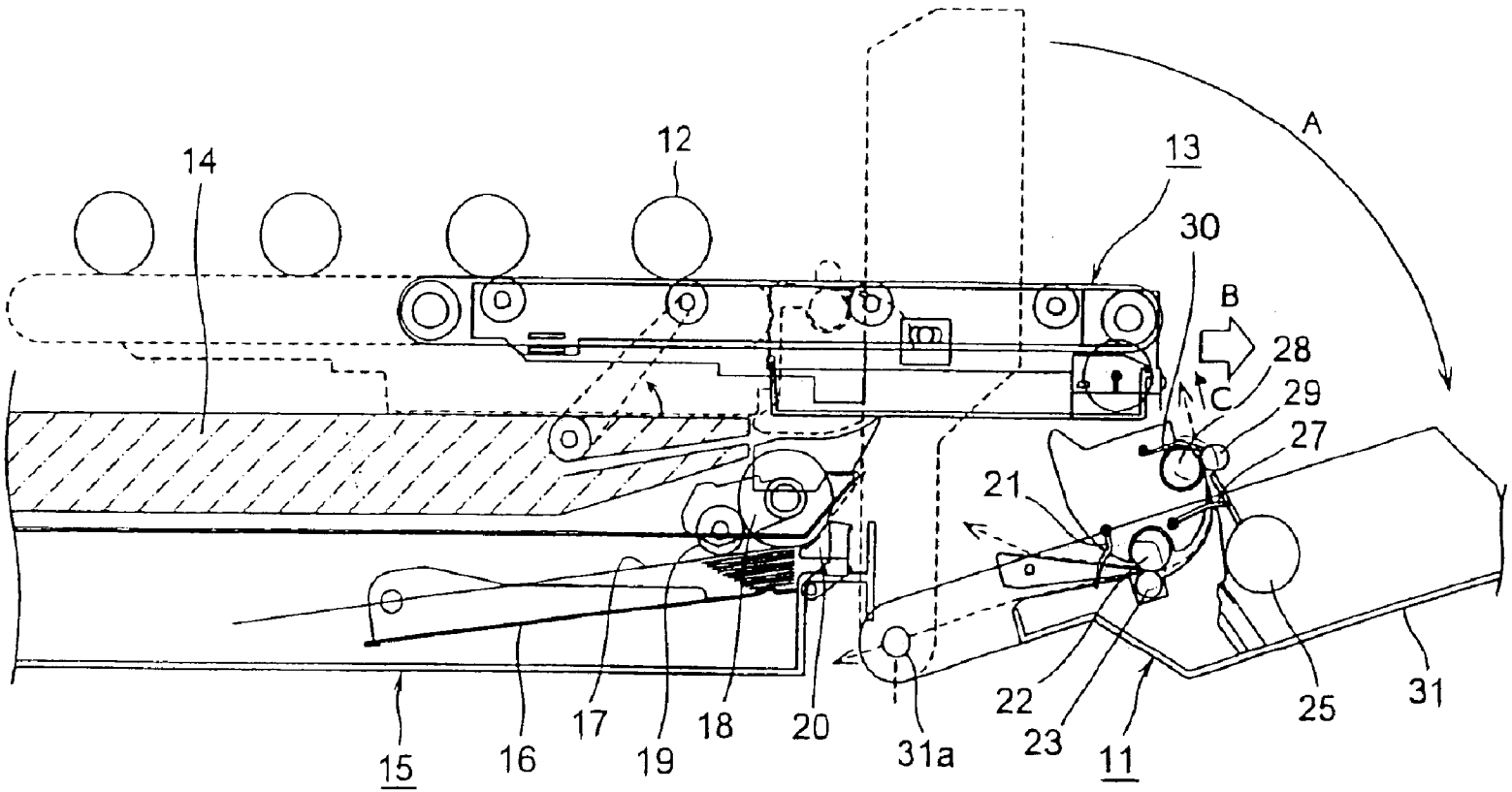

In FIGS. 1 and 2, a medium feeding device 10 feeds a medium, and a swinging member or a feeder unit 11 is provided on the main body of the image forming apparatus such that it can swing freely and functions as an open/close cover and a medium absorber. An image forming section 101 forms toner images of yellow, magenta, cyan, and black. Image carriers or image drums 12 are provided on the image forming section 101. Although not shown, a charging device or a roller, exposure device or LED head, development device including a development roller and a feeding roller, and cleaning device including a cleaning roller and a cleaning blade are provided around the image drums 12. The surface of each image drum 12 is equally and uniformly charged by the charging roller. Then, the surface of the image drum is exposed by the LED head to provide an electrostatic latent image. The development roller develops the electrostatic latent image formed on the surface of the image drum 12 to provide a toner image. During this operation, the image drum and each roller are rotated.

A transfer belt unit 13 is provided such that it can be pulled out freely from the main body. The transfer belt 13 comprises a drive roller R1, a driven roller R2, a transfer belt 102, and transfer rollers 103. The transfer belt 102 is provided between the drive and driven rollers R1 and R2. The transfer belt 102 is an endless belt to transport a medium for transferring the toner images of various colors onto the medium 17. The respective image drums 12 are arranged in the movement direction of the transfer belt 102. The drive roller R1 is rotated by a transportation motor (not shown) in a first driving section in order to move the transfer belt 102. Each transfer roller 103 is provided at a position opposed to each image drum 12 with the transfer belt 102 therebetween. A both-side image forming unit 14 forms images on both sides of the medium 17, such as paper and OHP. The both-side image forming unit 14 transports the medium 17, on one side of which an image has been printed. A switching unit (not shown) is provided before the both-side image forming unit 14 to switch the transportation direction of the medium 17 having the printed image on the one side thereof.

A detachable medium accommodation section or medium feed cassette 15 is provided on the medium feeding device 10. The medium feed cassette 15 holds the medium 17 on a sheet receiving plate 16 in a laminated condition. A hopping roller 18 is provided at the front end (right end in the figure) of the medium feed cassette 15. A first bias member or spring 16*a* is provided under the sheet receiving plate 16 so as to bias the sheet receiving plate 16 toward the side of the hopping roller 18. The uppermost medium 17 in the medium feed cassette 15 is biased against the hopping roller 18 by the spring 16*a*. The hopping roller 18 is rotated by a first medium feed motor (not shown) in a second driving section so as to feed the medium 17 one by one.

A sub-roller 19 is provided for contact with the uppermost medium 17 in the medium feed cassette 15. The sub-roller 19 is biased against the medium 17 by a second bias member or spring (not shown) with a predetermined biasing force. Also, the sub-roller 19 assists the transportation of the medium 17. A separating frame 20 comprises a separating member 20*a* which is pressed by the hopping roller 18 for separating the medium 17 one by one. A first medium detection lever 21 is provided downstream in the feeding direction by the hopping roller 18. A first medium detection sensor 21*a* is provided at an end of the first detection lever 21. A first detection section is composed of the first detection lever 21 and sensor 21*a*. The first detection section detects the front end (right end in the figure) of the medium 17 being fed. A first medium feed section includes the medium feed cassette 15, hopping roller 18, sub-roller 19, and separating frame 20.

Reference number 22 denotes a first resist roller. A first pressure roller 23 is pressed against the first resist roller 22 by a third bias member or spring (not shown). The first resist roller 22 and the first pressure roller 23 constitute a first pair of resist rollers or a first pair of rollers. A control section (not shown) detects the medium 17 fed by the hopping roller 18 by the first medium detection section. The control section brings the front end of the medium 17 to the first pair of resist rollers when detecting the medium 17. Afterwards, the control section transports the medium 17 by a predetermined distance and stops the rotation of the hopping roller 18. Consequently, the skew of the medium 17 is corrected by the first pair of resist rollers.

A multi-purpose feeder 24 is provided with a multi-purpose feeder roller 25. The multi-purpose feeder roller 25 is rotated by a second medium feed motor (not shown) in a third driving section. The multi-purpose feeder roller 25 feeds the medium 17 one by one. A second medium detection lever 27 is provided downstream in the feeding direction by the multi-purpose feeder 24. A second medium detection sensor 27*a* is provided at an end of the second detection lever 27. A second detection section is composed of the second detection lever 27 and sensor 27*a*. The second detection section detects the front end of the medium 17 fed by the multi-purpose feeder 24. A second medium feed section includes of the multi-purpose feeder 24, and multi-purpose feeder roller 25.

Reference number 28 denotes a second resist roller. A second pressure roller 29 is pressed against the second resist roller 28 by a fourth bias member or spring (not shown). The second resist roller 28 and the second pressure roller 29 constitute a second pair of resist rollers or a second pair of rollers. The control section detects the medium 17 fed by the multi-purpose feeder roller 25 by the second medium detection section. The control section brings the front end of the medium 17 to the second pair of resist rollers when detecting the medium 17. Afterwards, the control section transports the medium 17 at a predetermined distance and stops the rotation of the multi-purpose feeder roller 25. Consequently, the skew of the medium 17 is corrected by the second pair of resist rollers.

As stated above, the skew of the medium 17 is corrected by the first and second pairs of resist rollers. The medium 17 is transported by the rotation of the first and second resist rollers 22 and 28. The medium 17 is further transported by the transfer belt 102 to the image forming section 101.

A write sensor lever 30 is provided downstream of the second pair of resist rollers in the feeding direction of the medium 17. A third medium detection sensor 30*a* is provided at an end of the write sensor lever 30. A third detection section is composed of the third detection lever 30 and sensor 30*a*. The third detection section detects the front end of the medium 17 fed by the second pair of resist roller. The control section forms the toner image on the respective image drums 12 when the third section detects the front end of the medium 17. The toner images formed on the respective image drums 12 are transferred onto the medium 17 transported by the respective transfer roller 1103 at a predetermined timing.

The feeder unit 11 comprises the first and second pairs of resist rollers, the first, second, and third medium detection sections (the first and second medium detection levers 21 and 27, the write sensor lever 30, and the first, second, and third medium detection sensors), and the multi-purpose feeder 24. The feeder unit 11 is provided such that it can swing freely about a rotation fulcrum 31*a* as a rotation center with respect to the main body of the apparatus. The feeder unit 11 can take a first position shown in FIG. 1 or a second position shown FIG. 2. When removing the jammed medium 17, the user rotates the feeder unit 11 in a direction of A to the second position so that the user accesses the medium 17 caught between the first and second pairs of resist rollers. Accordingly, the user can remove the jammed medium easily. Also, it is possible to take out the transfer belt unit 13 in a direction of B. Accordingly, the user can easily remove the medium 17 jammed on the transfer belt 13 by taking out the transfer belt unit 13. Moreover, the user can easily take out the transfer belt unit 13 from the front side (right side of FIG. 2) of the apparatus. Thus, the user can also replace the transfer belt unit 13 easily.

The feeder unit 11 is provided with the first and second pair of resist rollers. The first and second pairs of resist rollers are separated from the main body when the feeder unit 11 is opened. However, the first and second resist rollers, and the first and second pressure rollers 23 and 29 are not separated from each other when the feeder unit 11 is opened. Accordingly, the pressure between the first and second resist rollers 22 and 28, and the first and second pressure rollers 23 and 29 is not changed over years. Consequently, the first and second resist rollers 22 and 28 together with the first and second pressure rollers 23 and 29 transport the medium 17 in a stable condition.

The feeder unit 11 is further provided with the first, second, and third medium detection sections, and the front cover 31. That is, the first medium detection lever 21 and sensor 21*a*, the second medium detection lever 27 and sensor 27*a*, the write sensor lever 30, and the third medium detection sensor 30*a* are separated from the main body when the feeder unit 11 is opened. Accordingly, the first and second medium detection levers 21 and 27, and the write sensor lever 30 do not receive any force in a direction opposite to the feeding direction of the medium when the jammed medium 17 is taken out to this side (a direction of arrow C in FIG. 2). Accordingly, the first and second medium detection levers 21 and 27, and the write sensor lever 30 do not become rickety so that the detection accuracy of the first, second, and third medium detection sections is high.

Since the first and second pairs of resist rollers are separated from the main body, the first resist and pressure rollers 22 and 23, and the second resist and pressure rollers 28 and 29 do not become rickety.

In addition, since the first and second pairs of resist rollers, the first and second, and third medium detection sections are separated from the main body with the feeder unit 11, there is no obstacle to block the removal of the transfer belt unit 13. Accordingly, the transfer belt unit 13 can be easily taken out from the front side of the main body (in a direction of B in FIG. 2).

The frame and medium guide of the feeder belt unit 11 will now be described.

Figure 3:
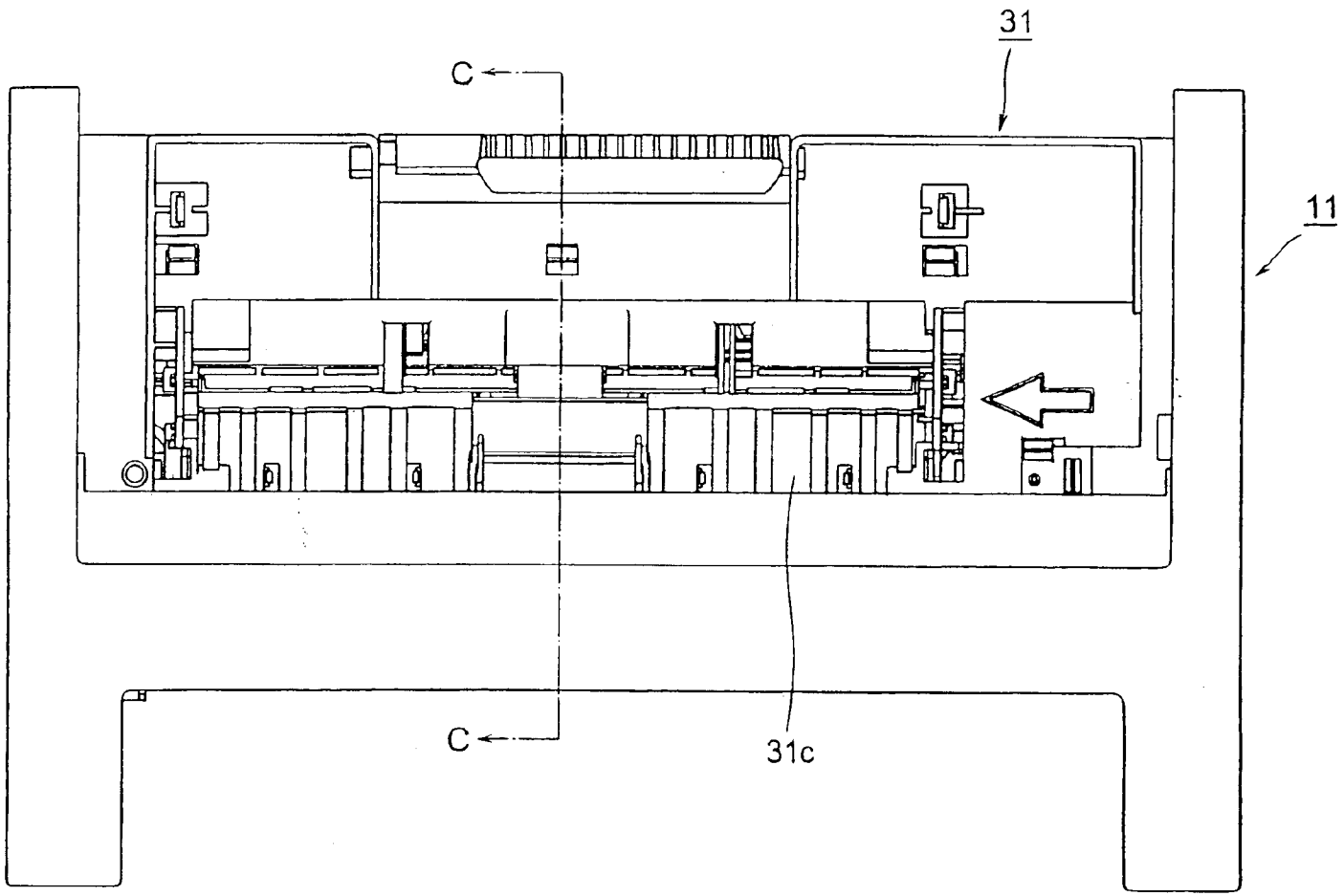
FIG. 3 is a front view of a feeder unit according to the first embodiment of the present invention.

In FIG. 3, reference number 31*c* denotes a transportation path of the medium 17.

In FIGS. 3–7, the feeder unit 11 is provided with a front cover 31 functioning as an outer cover and a medium guide. The front cover 31 is provided with a receiver 31*f* to receive the rotation fulcrum 31*a* for rotation of the front cover 31. The front cover 31 is further provided with medium guides 31*b* to 31*d* for guiding the medium 17. A feeder frame 32 is fixed to the front cover 31. The feeder frame 32 is provided with medium guides 32*a* to 32*c* for guiding the medium 17. The feeder frame 32 is further provided with a support 32*f* receive the rotation fulcrum 31*a*. The medium 17 which is fed from an optional tray (not shown) constituting the third medium feeding sections is guided by the first pair of resist rollers along the medium guide 31*b* as shown by a broken line L1. The medium 17 which is fed from the first pair of the resist rollers is guided by the second pair of resist rollers along the medium guides 31*b* and 32*c* as shown by a broken line L2. The medium 17 which is fed from the multi-purpose feeder roller 25 is guided by the second pair of resist rollers along the medium guides 31*d* and 32*c* as shown by a broken line L3.

The feeder frame 32 holds the first and second resist rollers 22 and 28, the first and second pressure rollers 2 and 29, the first and second medium detection levers 21 and 27, and the write sensor lever 30. A top guide 33 guides the medium 17 which is fed by the multi-purpose feeder roller 25, to the second pair of resist rollers. The top guide 33 holds the multi-purpose feeder roller 25.

An inner guide 34 guides the medium 17 which is fed by the optional tray, to the first pair of resist rollers. the inner guide 34 further guides the medium 17 which is fed by the both-side image forming unit 14, to the first pair of resist rollers. A release lever 52 opens or closes the feeder unit 11. A slide post 55 engages or disengages the release lever 52 with or from the main body when the release lever 52 is operated. The slide post 55 is accommodated in an accommodation section 33*a* formed by the top guide 33.

The first and second pairs of resist rollers will be described. Since they have the same structure, only the first pair of resist rollers is described.

Figure 8:
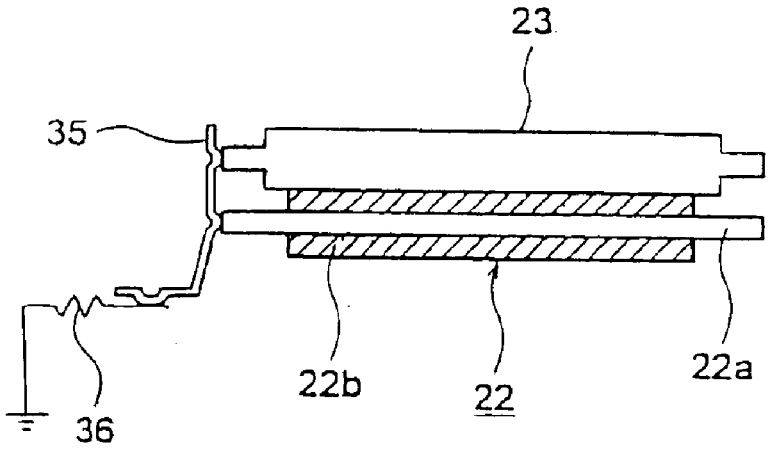
FIG. 8 is a cross-sectional view of a first pair of resist rollers according to the first embodiment of the present invention.

In FIG. 8, reference number 22 denotes the first resist roller and reference number 23 the first pressure roller made of a metal. The first resist roller 22 is composed of a shaft 22*a* made of a metal and a body member 22*b* made of a rubber.

When the medium 17 slides on the medium guides 31*b* to 31*d* and 32*a* to 32*c*, the friction caused by the sliding movement produces static electricity on the medium 17. The shaft 22*a* and the first pressure roller 23 are provided such that they are in contact with a ground plate 35. The ground plate 35 prevents the medium 17 from being charged with the static electricity. However, the electrical charge of the toner image escapes if the static electricity is removed in a short time. Accordingly, the ground plate is grounded through a resistor 36 so as to prevent the escape of the toner electrical charge.

Figure 9:
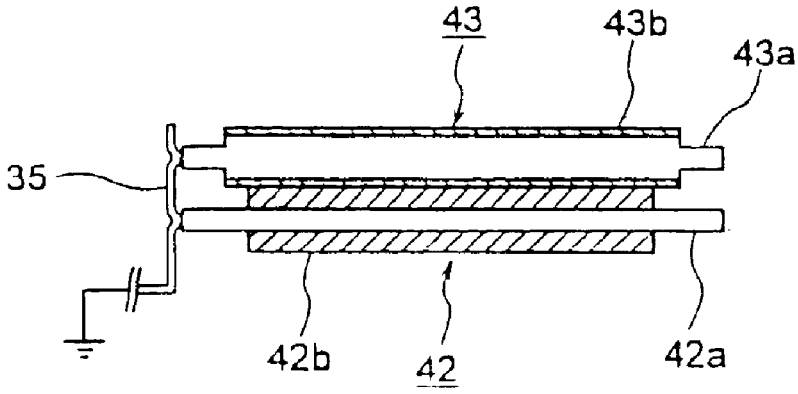
FIG. 9 is a cross-sectional view of anther first pair of resist rollers according to the first embodiment of the present invention.

In FIG. 9, a first resist roller 42 of another first pair of resist rollers is composed of a shaft 42*a* made of a metal and a body member 42*b* made of an insulating rubber having a resistance of, for example, more than $1.0*10^9$ (Ω). A first pressure roller 43 is composed of a shaft 43*a* made of a metal and a cover 43*b* made of an insulating resin. The ground plate 35 can be directly grounded.

The operation of the feeder unit 11 will be described. Firstly, the case that the medium 17 is fed from the medium feed cassette 15 will be described.

The medium 17 is set in the medium feed cassette 15, laminated on the sheet receiving plate 16. The uppermost medium 17 is pressed against the hopping roller 18. When receiving a medium feed signal, the control section drives the first feed motor to simultaneously rotate the hopping roller 18, sub-roller 19, and the second pair of resist rollers. The medium 17 is separated from the other medium by the separating frame 20 so as to be fed.

The first medium detection section detects the front end of the medium 17 when the medium 17 arrives at the first detection lever 21. The control section brings the front end of the medium 17 to the first pair of resist rollers. Afterwards, the control section transports the medium 17 by a predetermined distance to correct the skew of the medium 17. The rotation of the hopping roller 18 and sub-roller 19 is stopped when the correction of the skew of the medium 17 is finished. Then, the first pair of resist rollers is rotated so that the medium 17 is transported to the second pair of resist rollers.

Since the second pair of resist rollers has been already rotated, the medium 17 is further transported. The third medium detection section detects the front end of the medium 17 when the front end of the medium 17 passes the second pair of resist rollers and arrives at the write sensor lever 30. The control section forms a toner image on the surface of the image drum 12, by timing the start of print based upon the detection of the front end of the medium 17. The control section then transfers the toner image onto the medium 17 with a predetermined timing.

The first medium detection section detects that the rear end of the medium 17 has passed the first medium detection lever 21. When detecting that the rear end of the medium 17 has passed the first pair of resist rollers, the control section determines that the next medium 17 can be fed. The control section then starts feeding operation of the next medium 17 if there is data to be printed.

Secondly, the case that the medium 17 is fed from the multi-purpose feeder 24 will be described.

When receiving a feed signal, the control section drives the second feed motor to rotate the multi-purpose feeder roller 25 (at this point, the second pair of resist rollers is not rotated). The stacked medium 17 is separated by the multi-purpose feeder roller 25 for feeding one by one. The second medium detection section detects the front end of the medium 17 when the front end arrives at the second medium detection lever 27. Then, in the same way as in the case of the medium feed cassette, the front end is abutted against the second pair of resist rollers so that the skew is corrected. The rotation of the multipurpose feeder roller 25 is stopped when the skew of the medium 17 is corrected.

Since the second pair of resist rollers is rotated, the medium 17 is transported again. The third medium detection section detects the front end of the medium 17, when the front end arrives at the write sensor lever 30. The control section forms a toner image on the surface of the image drum 12, by timing the start of print based upon the detection of the front end of the medium 17. The control section then transfers the toner image onto the medium 17 with a predetermined timing.

The second medium detection section detects the rear end of the medium 17 when the rear end of the medium 17 has passed the second medium detection lever 27. When detecting that the rear end of the medium 17 has passed the second pair of resist rollers, the control section determines that the next medium 17 can be fed. The control section starts feeding operation of the next medium 17 when receiving the feed signal.

Attachment of the feeder unit 11 to the main body will be described.

Figure 10:
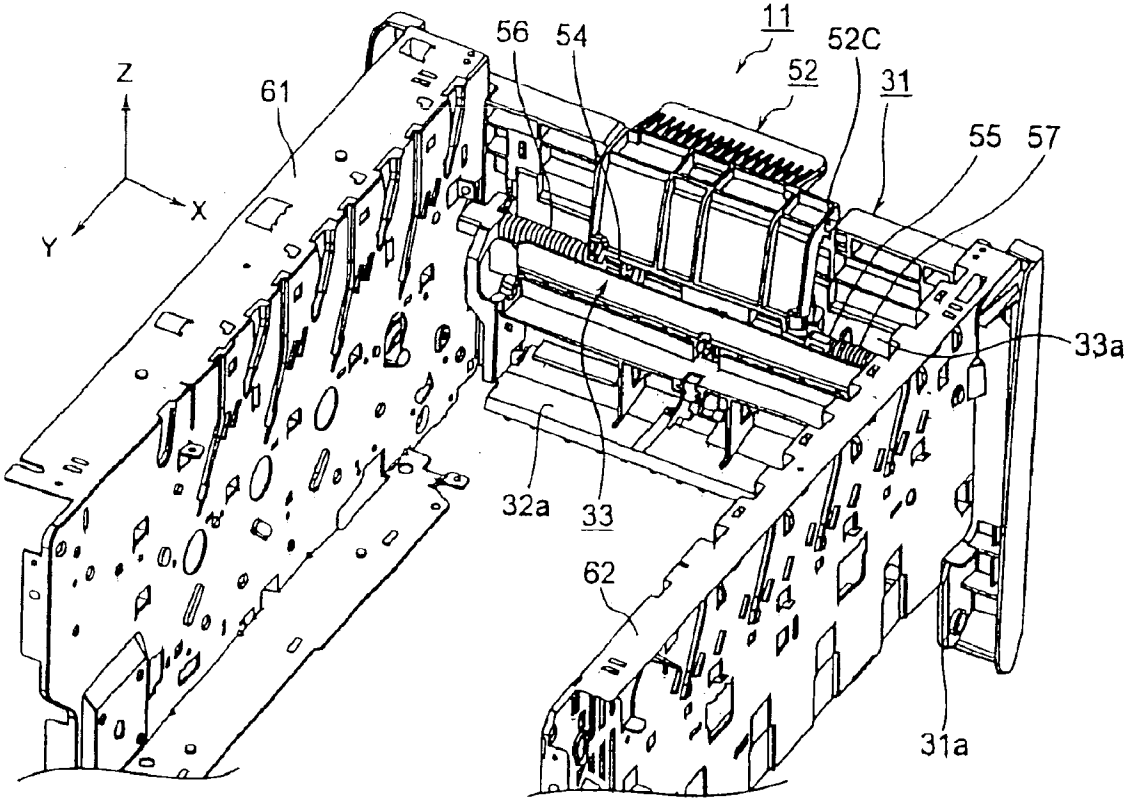
FIG. 10 is a perspective view of the feeder unit and a main frame according to the first embodiment of the present invention.
Figure 11:
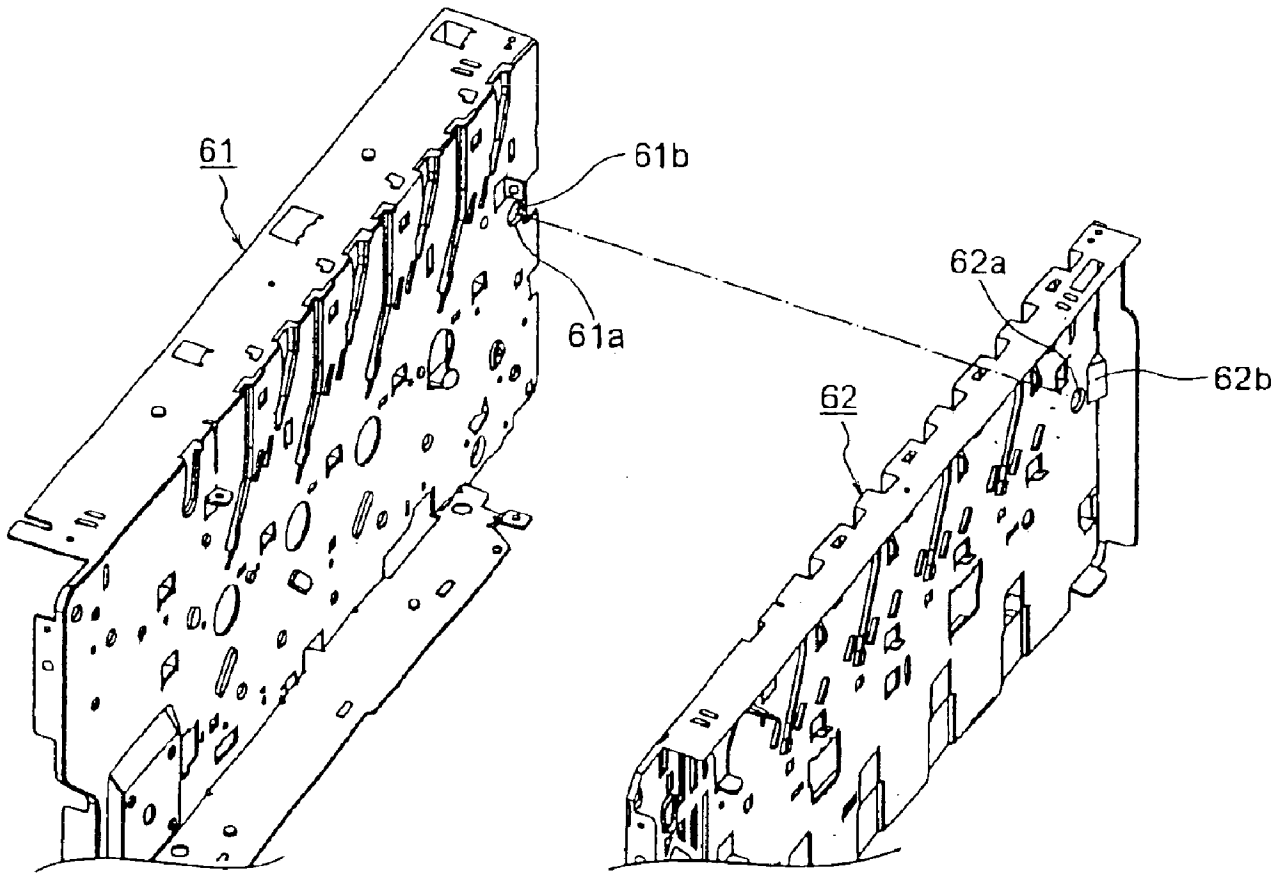
FIG. 11 is a perspective view of the main frame according to the first embodiment of the present invention.

In FIGS. 10–13, reference number 11 is the feeder unit, 31 the front cover, and 61 and 62 main frames of the image forming apparatus. When the feeder unit 11 is closed, as shown in FIG. 10, specific portions of the front cover 31 are brought into contact with front end surfaces (right end surfaces in FIG. 10) of the main frames 61 and 62. An operating member or release lever 52 is substantially L-shaped and is supported such that it can be swung freely around hinges 52*b* and 52*c* as a center of the swing at an upper end of the front cover. The release lever 52 comprises a handle 52*a* which extends from the hinges 52*b* and 52*c* in a horizontal direction and handled by the user. The release lever 52 further comprises a lower portion 52*d* extending downwardly from the hinges 52*b* and 52*c*. Engaging portions 52*e* and 52*f* are provided at both sides of a lower end of the lower portion 52*d*. The engaging portions 52*e* and 52*f* are inclined from the front side (left side in FIG. 12) to the rear side (right side in FIG. 12) and constitute cams.

Slide posts 54 and 55 are provided such that they can move freely in an accommodation portion 33*a* formed at a predetermined position of the top guide 33. The slide posts 54 and 55 are moved by the operation of the release lever 52 so as to disengage the feeder unit from the main body. Engaged apertures 54*b* and 55*b* are provided at inner ends of the slide posts, respectively, as engaged members. The engaged apertures 54*b* and 55*b* have inclined faces which correspond to the engaging portions 52*e* and 52*f* to receive the cams. The outer ends of the slide posts 54 and 55 are freely inserted into and removed from circular burring holes 61*a* and 62*a* provided in the main frames 61 and 62, respectively. The first positioning element is constituted by the outer ends of the slide posts 54 and 55. The second positioning element is constituted by the burring holes 61*a* and 62*a*.

The slide posts 54 and 55 are provide with reset springs 56 and 57 as bias members, which bias the slide posts 54 and 55 toward the main frames 61 and 62. The inner ends of the reset springs 56 and 57 are brought into contact with specific portions of the front cover 31, and the outer ends of the reset springs 56 and 57 are brought into contact with ring-shaped swellings 54*a* and 55*a* provided at predetermined positions of the slide posts 54 and 55. A lock mechanism includes the slide posts 54 and 55, reset springs 56 and 57, and burring holes 61*a* and 62*a*.

The outer ends of the slide posts 54 and 55 are inserted into the burring holes 61*an* and 62*a*, respectively, so that the feeder unit 11 is placed at the right position with respect to and fixed to the main body of the apparatus and main frames 61 and 62. When the outer ends of the slide posts 54 and 55 are taken out from the burring holes 61*a* and 62*a*, the feeder unit 11 can be swung to be opened and closed.

The open/close operation of the feeder unit 11 for removing the jammed medium 17 will be described. Firstly, the method of opening the feeder unit 11 is described.

Figure 12:
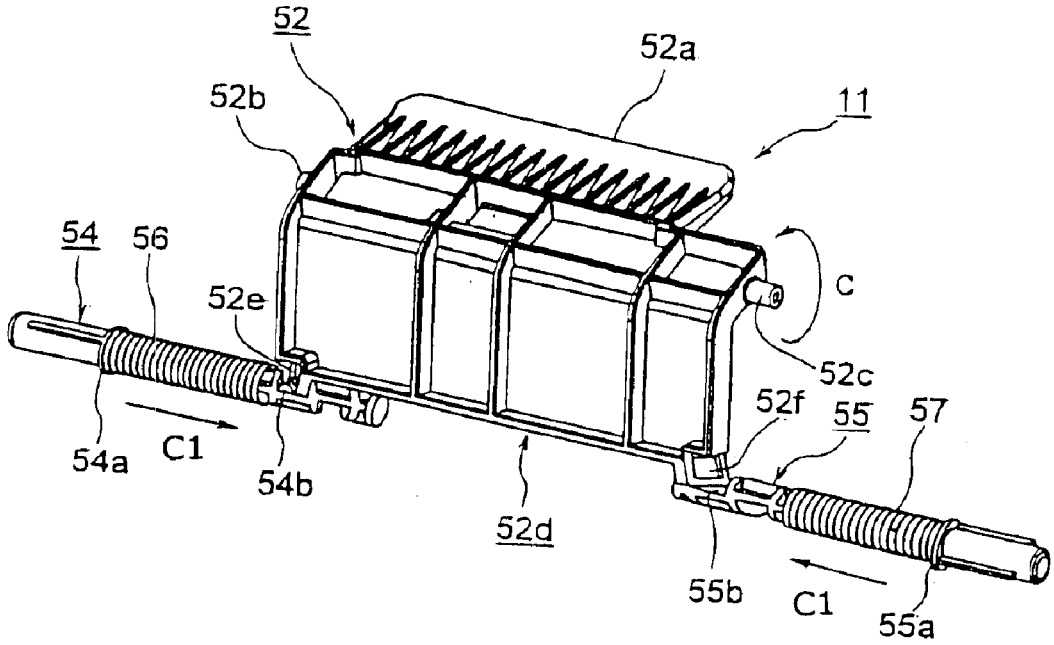
FIG. 12 is a perspective view of an open/close operation section of the feeder unit according to the first embodiment of the present invention.

The user rotates the release lever 52 in a direction of C (FIG. 12). The engaging portions 52*e* and 52*f* move with respect to the engaged apertures 54*b* and 55*b*. The slide posts 54 and 55 move in an inward direction of c1, against the bias of the reset springs 56 and 57. At this point, respective outer ends of the slide posts 54 and 55 are taken out from the burring holes 61*a* and 62*a* so that the feeder unit 11 is disengaged from the main body of the apparatus. Accordingly, the feeder unit is opened by pulling the release lever 52.

Secondly, the method of closing the feeder unit 11 will be described.

Figure 13:
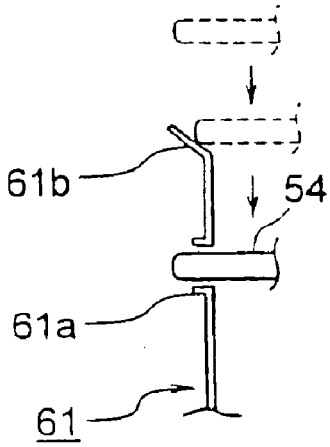
FIG. 13 is a schematic diagram showing the operation of a slide post when the feeder unit according to the first embodiment of the present invention is opened/closed.
Figure 14:
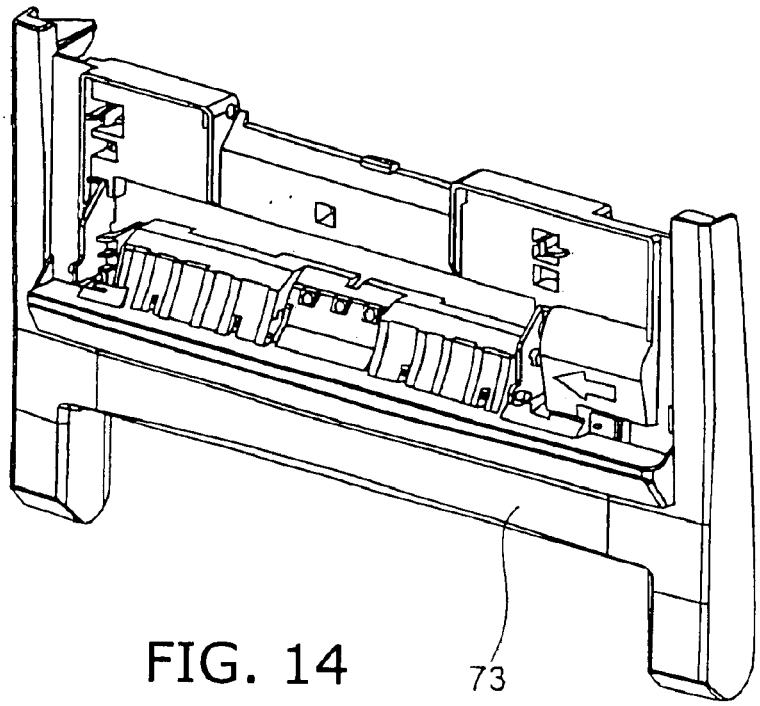
FIG. 14 is a front perspective view of a front cover according to the second embodiment of the present invention.
Figure 15:
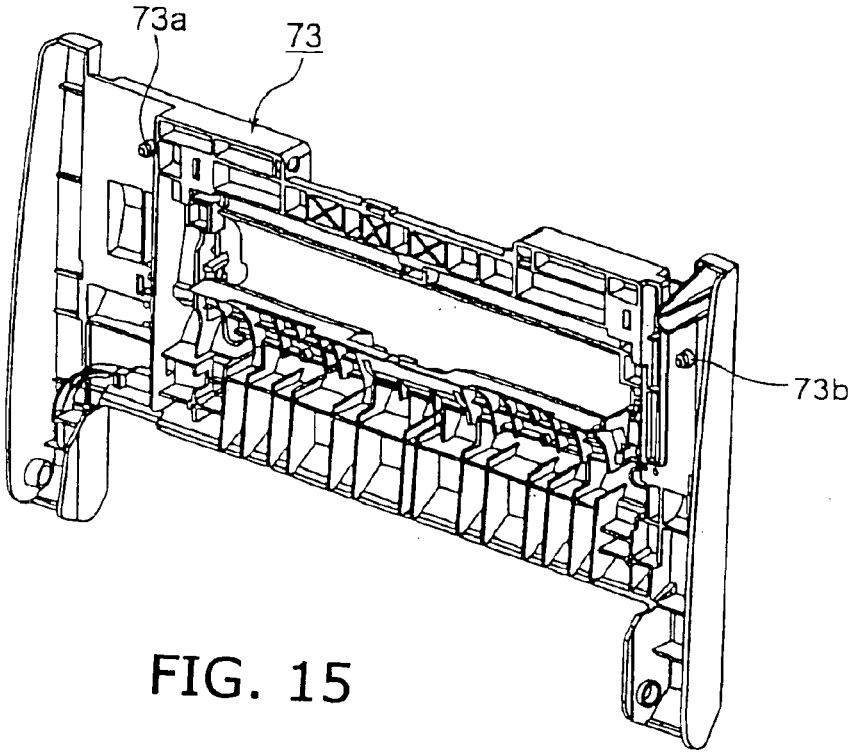
FIG. 15 is a rear perspective view of the front cover according to the second embodiment of the present invention.
Figure 16:
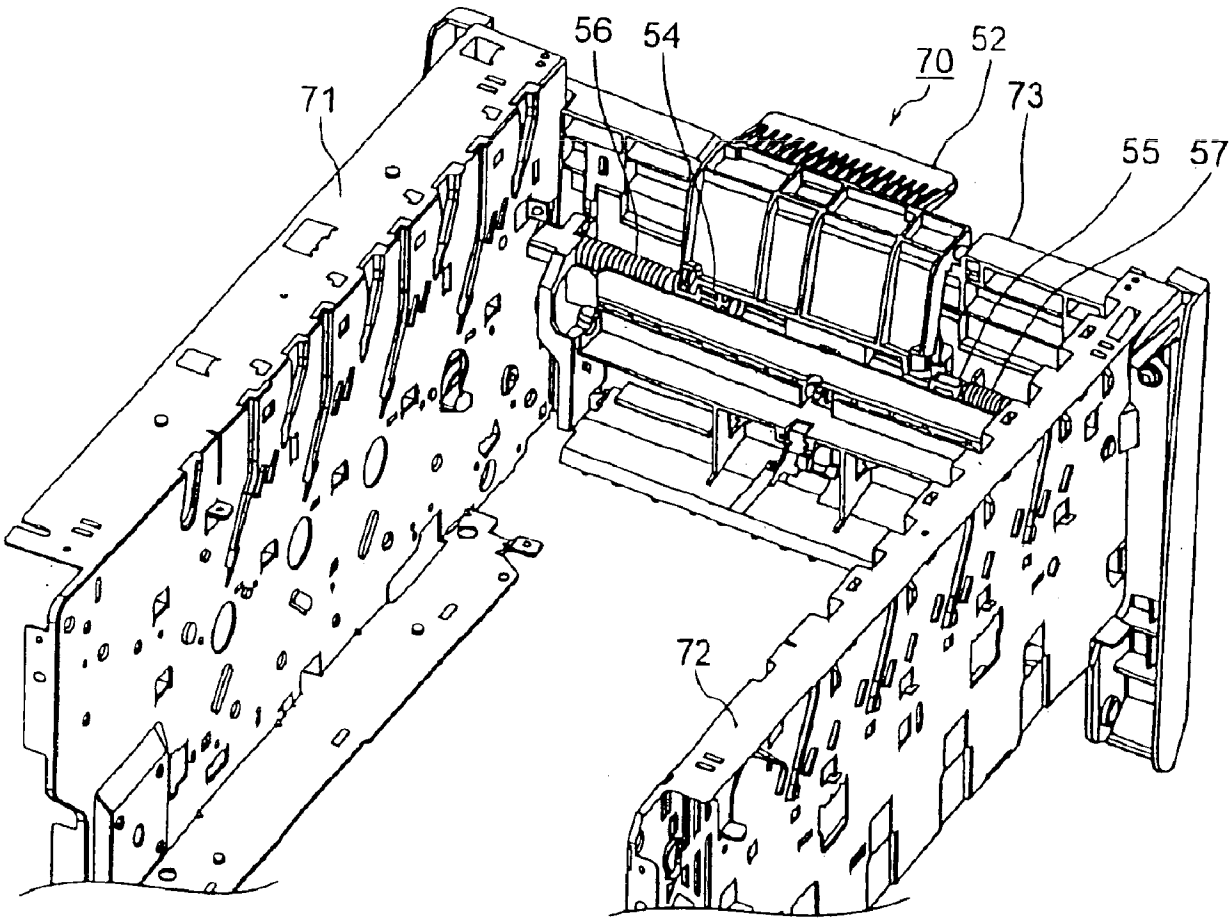
FIG. 16 is a perspective view of a feeder unit and a main frame according to the second embodiment of the present invention.
Figure 17:
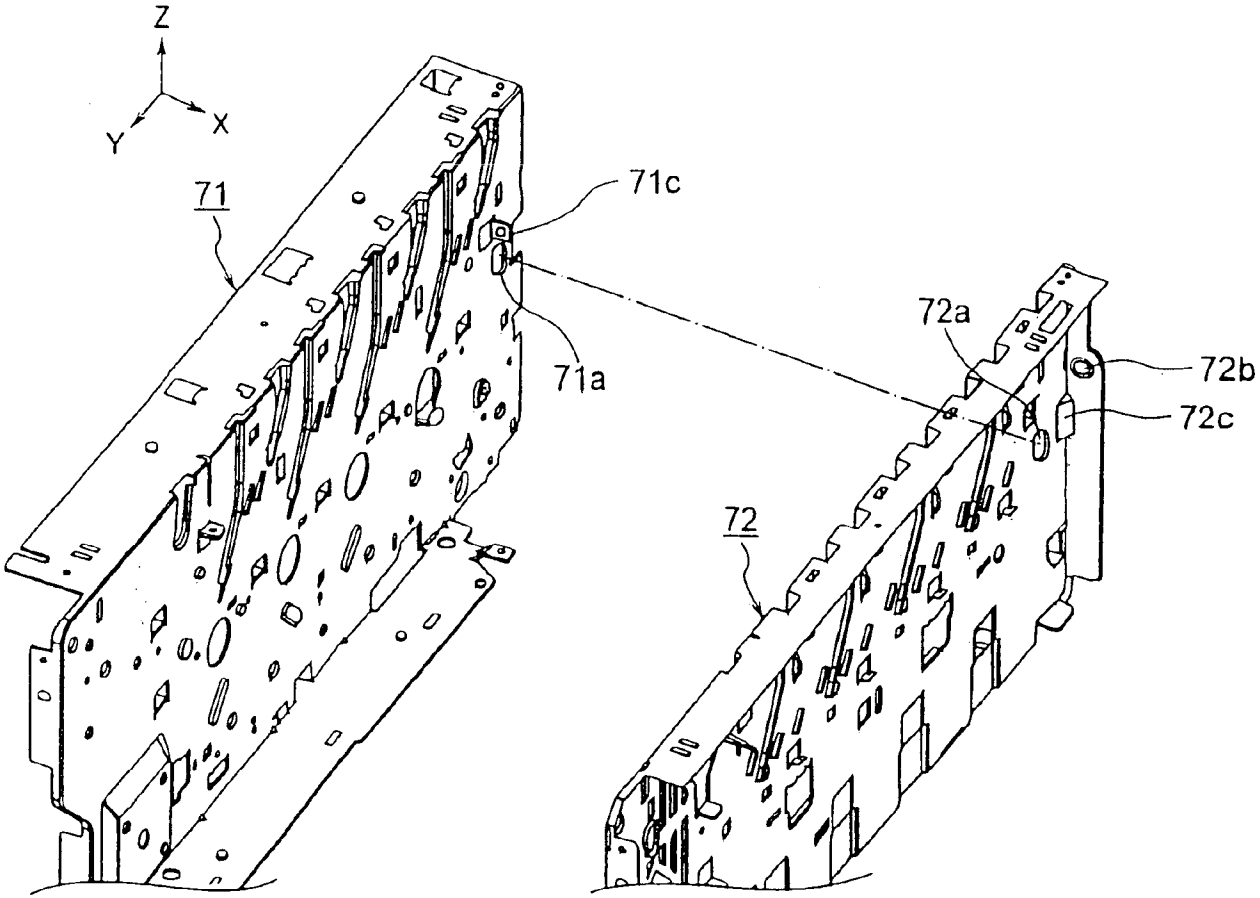
FIG. 17 is a perspective view of the main frame according to the second embodiment of the present invention.

The user pushes the feeder unit 11 with the release lever 52. As shown in FIG. 13, the outer ends of slide posts 54 and 55 abut against guide portions 61*b* and 62*b* of the main frames 61 and 62 (only the slide post 54, main frame 61, and guide portion 61*b* are shown in FIG. 13). The outer ends move in the direction of arrows along the guide portions 61*ba* and 62*b*. At this point, the slide posts 54 and 55 move inwardly, resisting the bias force of the reset springs 56 and 57. When the feeder unit 11 is completely closed, the respective outer ends of the slide posts 54 and 55 are inserted into the burring holes 61*a* and 62*a*. The positioning of the feeder unit with respect to the main body is determined and the feeder unit 11 is locked. The guide portions 61*b* and 62*b* are inclined from the front end (right side in FIG. 11) of the main frames 61 and 62 to the burring holes 61*a* and 62*a* and guide the outer ends of the slide posts 54 and 55 to the burring holes 61*an* and 62*a*.

As described above, the positioning of the feeder unit 11 with respect to the main frames 61 and 62 is determined during the open/close operation of the feeder unit 11. The positioning of the feeder unit 11 is determined at both ends of the feeder unit 11. Consequently, the image forming section 101 and the transfer section are maintained in parallel with the first and second pairs of resist rollers. Accordingly, the positioning accuracy of the image formed in the image forming apparatus is high.

Since it is possible to open or close the feeder unit 11 only by handling the release lever 52, the operation is very simple.

Figure 4:
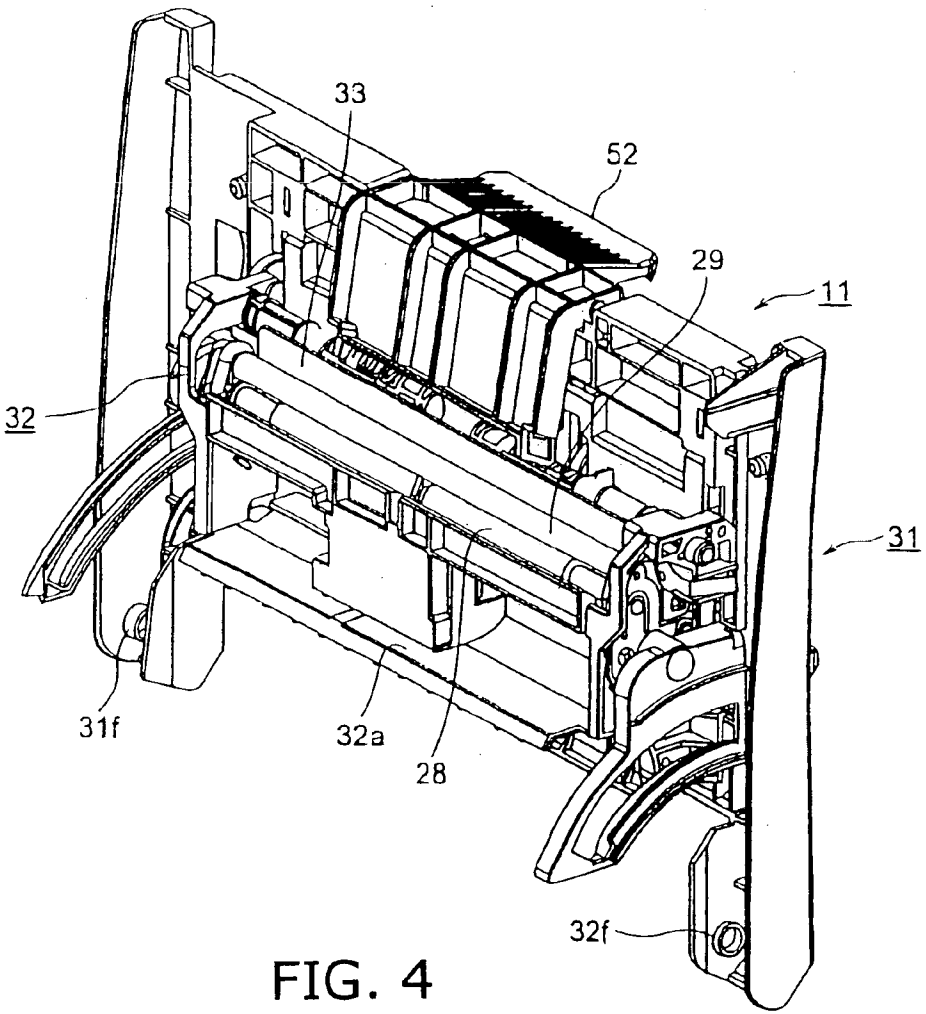
FIG. 4 is a rear perspective view of the feeder unit according to the first embodiment of the present invention.
Figure 5:
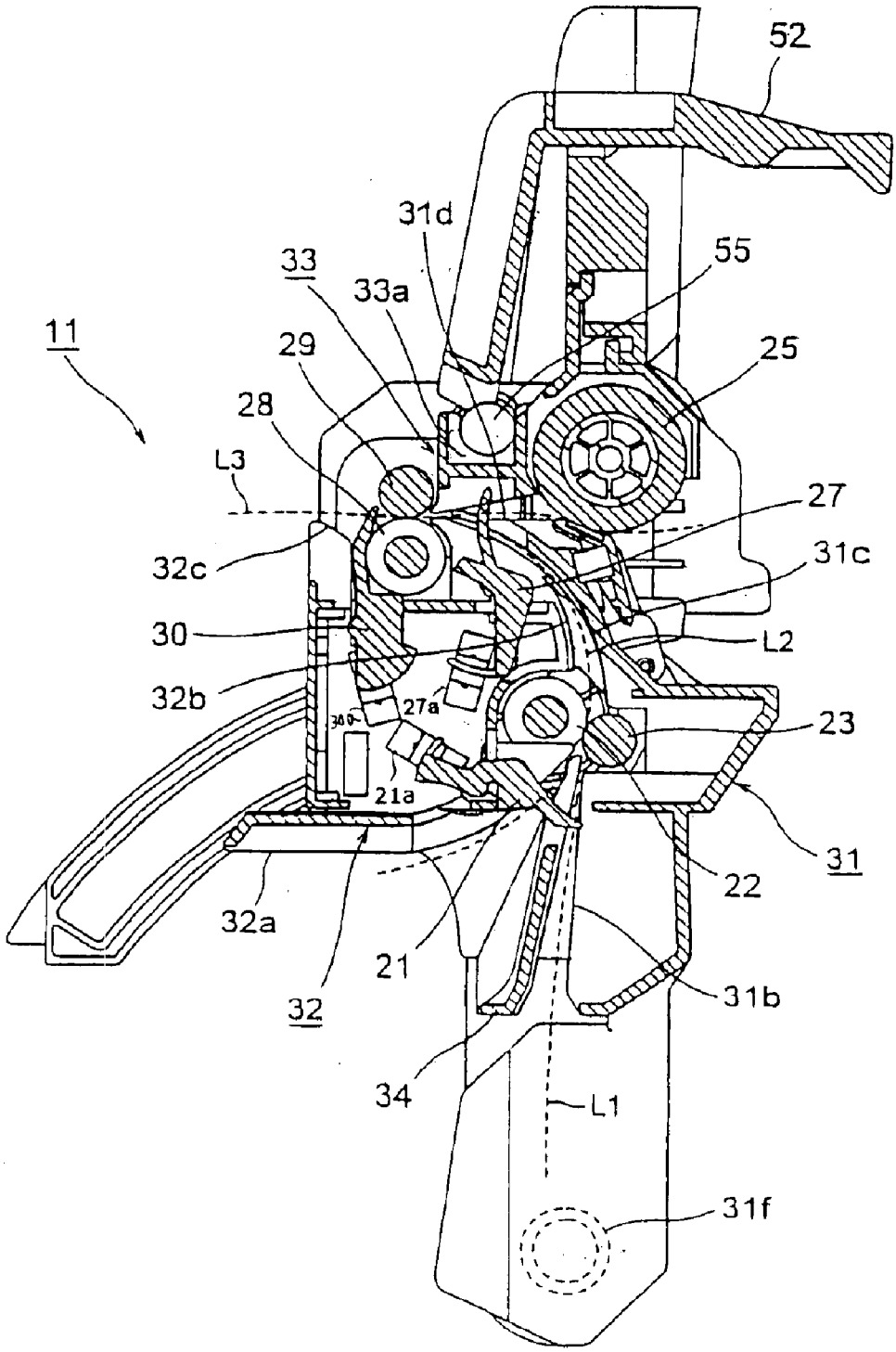
FIG. 5 is a cross-sectional view of FIG. 3 taken along the line C—C.
Figure 6:
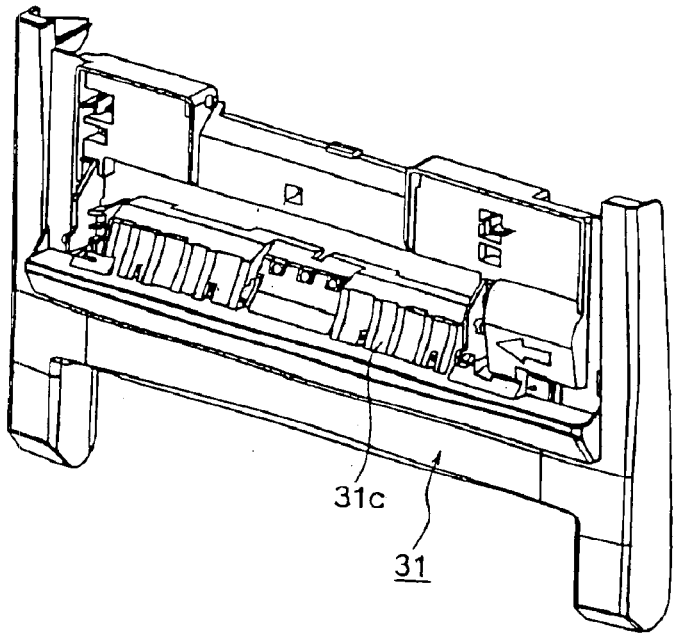
FIG. 6 is a front perspective view of a front cover according to the first embodiment of the present invention.
Figure 7:
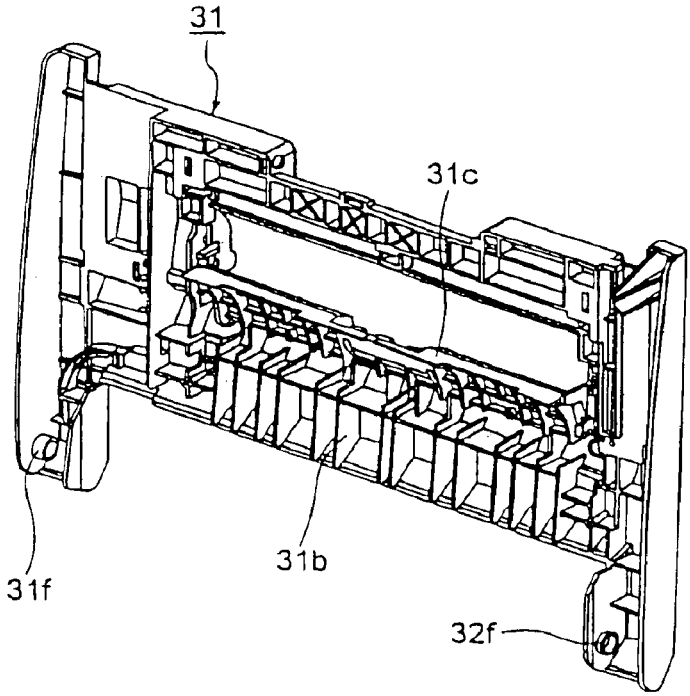
FIG. 7 is a rear perspective view of the front cover according to the first embodiment of the present invention.

As shown in FIG. 5, the second resist roller 28 is provided between the rotation fulcrum 31*a* and the slide posts 54 and 55 on the feeder frame 32 (FIG. 4). A axis support of the second resist roller 28, the accommodation portion 33*a* for the slide posts 54 and 55, and the support 32*f* for the rotation fulcrum 31*a* are supported by the feeder frame 32. The accommodation portion 33*a* is provided in the vicinity of the second resist roller 28 so as to increase the positioning accuracy of the feeder unit 11.

The parallelism (positioning accuracy) between the transfer section and the second resist roller 28 is required to be within ±0.05 in order to obtain good print accuracy. Accordingly, a distance Ls between the axis support of the second resist roller 28 and the accommodation portion 33*a* is less than 40 (mm) when the feeder frame is made of a resin, such as polyphenyleneether (PPE resign) or PPHOX. The distance Ls is required to be less than 100 (mm) when the feeder frame 32 is made of a resin including glass, such as ABS/PC resin (20% of GF)(acrylonitrile, butadiene, and stylene/polycarbonate).

(Second Embodiment)

In the first embodiment, the positioning of the feeder unit 11 is determined by the insertion of the outer ends of the slide posts 54 and 55 into the burring holes 61*a* and 62*a*. At this point, the slide posts 54 and 55 are provided such that they are movable in a widthwise direction X of the image forming apparatus. Also, the positioning of the feeder unit 11 is determined simultaneously for a depthwise direction Y and a heightwise direction Z of the image forming apparatus. Consequently, it is difficult for the outer ends of the slide posts 54 and 55 to enter the burring holes 61*a* and 62*a*. Therefore, the tension of the reset springs 56 and 57 is made so high that the operational force applied to the release lever 53 is required to be large, which reduces operational efficiency.

In the second embodiment, therefore, it is not required that the operational force applied to the release lever 52 be large, thus increasing the operational efficiency. The same reference numbers are used for elements having the same structure described in the first embodiment and the description thereof will be omitted.

In FIGS. 14–19, reference number 70 denotes a feeder unit or swinging member, 52 an operational member or release lever, and 71 and 72 main frames of the image forming apparatus. Burring holes 71*a* and 72*a* are provided in the main frames 71 and 72 at positions corresponding to the outer end surfaces of the reset springs 56 and 57. The burring holes 71*a* and 72*a* have a shape of elongated circle which has a long diameter in the heightwise direction of Z and a short diameter in the depthwise direction of Y. The lock mechanism includes the slide posts 54 and 55 as engaging/disengaging members, the reset springs 56 and 57, and the burring holes 71*a* and 72*a*.

The outer ends of the slide posts 54 and 55 are inserted into the burring holes 71*a* and 72*a*, respectively, so that the positioning of the feeder unit 70 in the depthwise direction is fixed with respect to the main body of the apparatus.

Burring holes 71*b* and 72*b* are provided in the main frames 71 and 72 in the vicinity of an upper end of the front end surface (right side in FIG. 16) corresponding to the feeder unit 70. The burring holes 71*b* and 72*b* have a shape of elongated circle which has a long diameter in the axial direction of X and a short diameter in the depthwise direction of Z. That is, the burring holes 71*b* and 72*b* are provided in the vicinity if a support portion for ratably supporting the second resist and pressures rollers 28 and 29. Positioning posts 73*a* and 73*b* are provided in the front cover 73 and project at positions corresponding to the burring holes 71*b* and 72*b*. The positioning posts 73*a* and 73*b* enter the 71*b* and 72*b*, respectively, so that the positioning of the main frame 71 with respect to the main body is determined and the main frame 71 is fixed to the main body. The first positioning element is determined by the outer ends of the slide posts 54 and 55, the second positioning element by the burring holes 61*a* and 62*a*, the third positioning element by the positioning posts 73*a* and 73*b*, and the fourth positioning element by the burring holes 71*b* and 72*b*.

The case that the feeder unit is opened for removal of the jammed medium will be described. The user rotates the release lever 52 in a direction of an arrow C. The engaging portions 52*e* and 52*f* move with respect to the engaging portions 54*b* and 55*b* of the slide posts 54 and 55. At this point, the outer ends of the slide posts 54 and 55 are taken out from the burring holes 71*a* and 72*a*, respectively, so that the main frame 71 is unlocked from the main body of the apparatus. The feeder unit 70 can be opened when the user pulls the release lever 53. The positioning posts 73*a* and 73*b* are taken out from the burring holes 71*b* and 72*b*, respectively.

Figure 18:
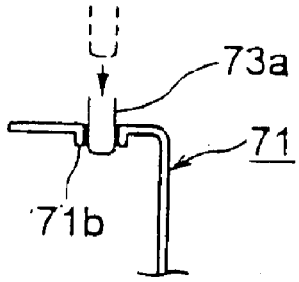
FIG. 18 is the first schematic diagram showing the operation of a slide post when the feeder unit according to the second embodiment of the present invention is opened/closed.
Figure 19:
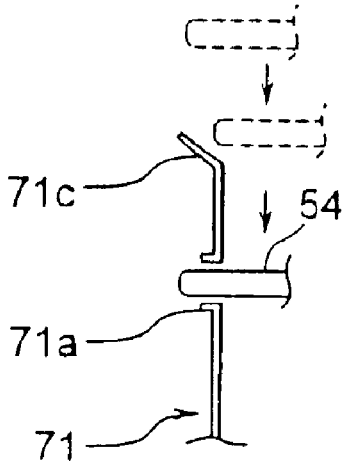
FIG. 19 is the second schematic diagram showing the operation of the slide post when the feeder unit according to the second embodiment of the present invention is opened/closed.

The case that the feeder unit 70 is closed will be described. The user pushes the feeder unit 70 with the release lever 52. As shown in FIG. 18, the positioning posts 73*a* and 73*b* enter the burring holes 71*b* and 72*b*, respectively. The positioning of the feeder unit 70 in the heightwise direction is determined with respect to the main body. As shown in FIG. 19, the outer ends of the slide posts 54 and 55 abut against the guide portions 71*c* and 72*c* of the main frames 71 and 72. The outer ends move in the direction of the arrow along the guide portions 71*c* and 72*c*. The slide posts 54 and 55 are moved inwardly, against the bias of the reset springs 56 and 57. When the feeder unit 70 is completely closed, the outer ends of the slide posts 54 and 55 enter the burring holes 71*a* and 72*a*, respectively. At this point, the positioning of the feeder unit 70 in the depthwise direction is determined with respect to the main body so that the feeder unit 70 is locked.

As stated above, in the second embodiment, the positioning posts 73*a* and 73*b* are inserted into the burring holes 71*b* and 72, respectively, so that the positioning in the direction of Z is determined. Consequently, the outer ends of the slide posts 54 and 55 can easily enter the burring holes 71*a* and 72*a*, respectively. Accordingly, the tension of the reset springs 56 and 57 is made so low that the operational force applied to the release lever 52 is made small, resulting in the increased operational efficiency.

(Third Embodiment)

In the first embodiment, the feeder unit 11 is disengaged from the gears of the motor for rotating the first resist roller when the feeder roller 11 is rotated about the rotation fulcrum 31*a*. Accordingly, the feeder unit 11 falls down because of its own weight in the forward direction about the rotation fulcrum 31*a* which is suddenly generated. An expensive damper has been required to prevent the sudden fall of the feeder unit 11.

In the third embodiment, the sudden fall of the feeder unit 11 is prevented without the expensive damper.

Figure 20:
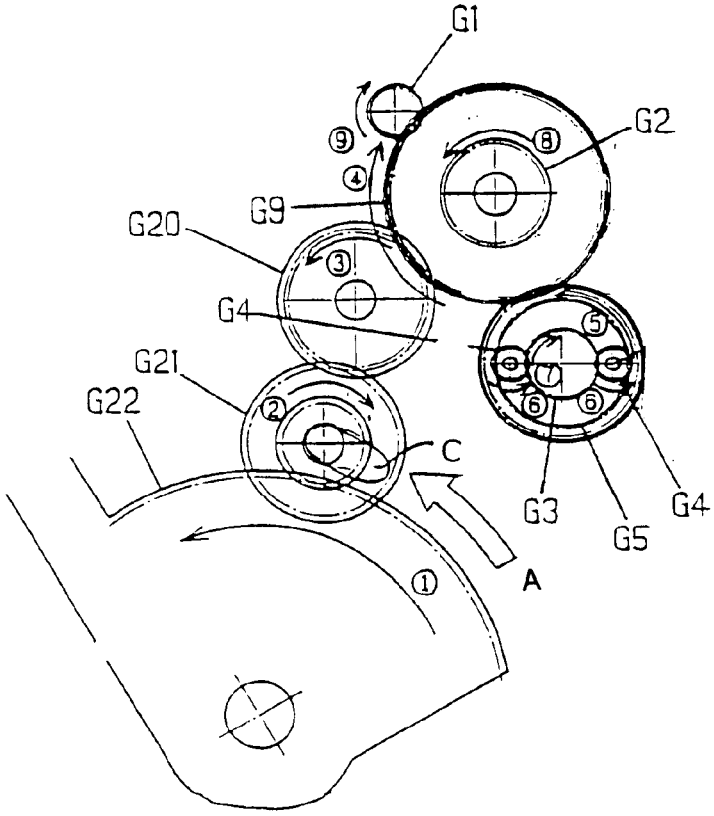
FIG. 20 is a schematic diagram showing the force transmission when the feeder unit according to the third embodiment of the present invention is opened.
Figure 21:
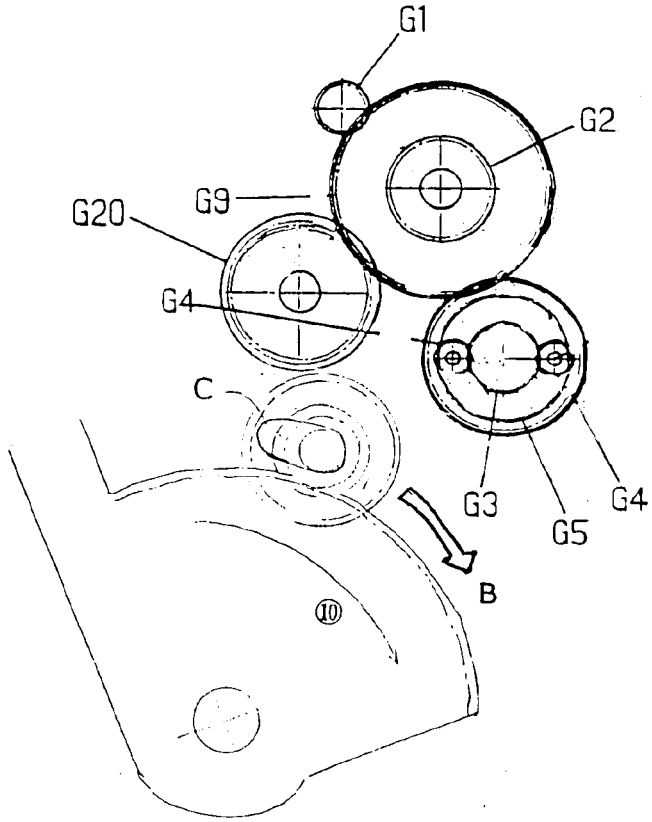
FIG. 21 is a schematic diagram showing the force transmission when the feeder unit according to the third embodiment of the present invention is closed.
Figure 22:
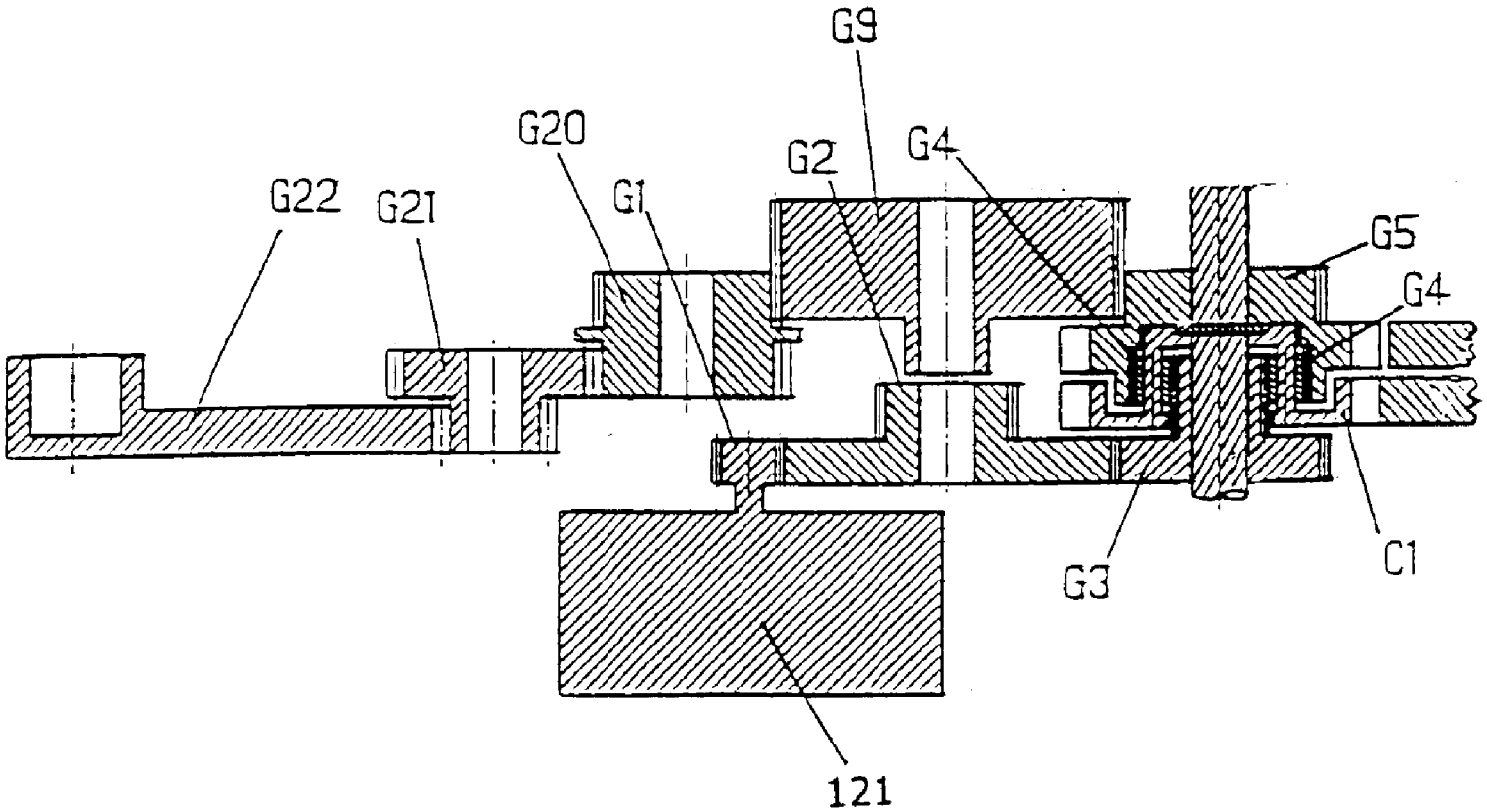
FIG. 22 is a schematic diagram showing a train of gears for the force transmission according to the third embodiment of the present invention.

In FIGS. 20–22, the feeder unit 11 is provided with a fan-shaped front cover gear G22 at the end thereof which meshes with a train of gears described below. A planet gear G21 meshes with the front cover gear G22 so as to receive driving force from the front cover gear G22. A reduction gear G20 meshes with the planet gear G21 to receive the driving force from the planet gear G21. An idle gear G9 meshes with the reduction gear G20 to receive the driving force from the reduction gear G20. A ring gear G5 meshes with the idle gear G9 to receive the driving force from the idle gear G9. A planet gear G4 meshes with the ring gear G5 to receive the driving force from the ring gear G5. A sun gear G3 meshed with the planet gear G4 to receive the driving force from the planet gear G4. A reduction gear G2 meshes with the sun gear G3 to receive the driving force from the sun gear G3. Also, the reduction gear G2 meshes with a motor gear G1 provided on an axis of the motor. The driving force used in the specification means force for rotating the gears, which is generated when the feeder unit is opened.

The operation of opening the feeder unit 11 will be described.

In FIG. 20, when the user opens the feeder unit 11, the front cover gear G22 is rotated in a direction of an arrow ①. The planet gear G21 is engaged with an elongated hole C such that it can move in the elongated hole C. The planet gear G21 moves in the elongated hole C in a direction of an arrow A and meshes with the reduction gear G20 by the rotation of the front cover gear G22. The planet gear G21 rotates in a direction of an arrow ②. The reduction gear G20 rotates in a direction of an arrow ③ by the rotation of the planet gear G21. The rotation of the reduction gear G20 is transmitted to the idle gear G9. The idle gear G9 rotates in a direction of an arrow ④4. The rotation of the idle gear G9 is transmitted to the ring gear G5. The ring gear G5 rotates in a direction of an arrow ⑤. The rotation of the ring gear G5 is transmitted to the planet gear G4. The planet gear G4 rotates in a direction of an arrow ⑥. The driving force of the planet gear G4 is transmitted to the sun gear G3. The sun gear G3 rotates in a direction of an arrow ⑦. The driving force of the sun gear G3 is transmitted to the reduction gear G2. The rotational force of reduction gear G2 is transmitted to the motor gear provided on the axis of the motor. The motor gear G1 rotates in a direction of an arrow ⑨. As described above, when the feeder unit 11 is opened, the driving force is transmitted from the front cover gear G22 to the motor gear G1 through the train of the gears. Consequently, the detent torque of a motor 121 prevents the sudden rotation of the feeder unit 11 by its own weight. That is, the detent torque of the motor 121 brings about a damper effect when the feeder unit 11 is opened. Thus, the feeder unit 11 is opened smoothly without the expensive damper.

In the above embodiment, an appropriate gear ratio is employed by combining a plurality of gears so that the user can open the feeder unit 11 smoothly. However, the number of the used gears may be decreased and the front cover gear G22 may be directly connected to the motor gear so as to make the structure simple. Also, belts may be used instead of the gears.

The operation of closing the feeder unit 11 will be described.

In FIG. 21, when the user closes the feeder unit 11, the front cover gear G22 is rotated in a direction of an arrow ⑩. The planet gear G21 is engaged with the elongated hole C such that it can move in the elongated hole C. The planet gear G21 moves in the elongated hole C in a direction of an arrow B so that it is disengaged from the reduction gear G20. Accordingly, the driving force of the planet gear G21 is not transmitted to the train of the gears and, therefore, receives no detent torque of the motor 121. That is, when the feeder unit 11 is closed, since there is no detent torque of the motor 121, the feeder unit 11 becomes free from damper effect. As a result, the feeder unit 11 can be closed smoothly with slight force.

In the third embodiment, when the feeder unit 11 is opened, the detent torque of the motor 121 prevents the sudden rotation of the feeder unit 11 by its own weight, and when the feeder unit 11 is closed, it is closed smoothly with slight force because it receives no detent torque of the motor 121.

The present invention is not limited to the above embodiments, and various variations and modifications based upon the concept of the invention are not excluded from the scope of the invention.

As fully described above, the image forming apparatus or medium feeding device according to the present invention comprises the swinging member provided on the main body such that it swings freely and the feeding member rotatably supported by the swinging member and transporting the medium supplied from the medium feed section to the image forming section which forms the image on the medium.

When the swinging member is swung, the user can access the medium feed section so as to take out the jammed medium to user's side, thus solving the jam easily.

Also, it is easy to take out the transfer belt unit for transporting the medium, to the front side of the apparatus so as to remove the jammed medium on the transfer belt unit. In addition, it is easy to replace the transfer belt unit.

Since a pair of rollers for holding the medium therebetween to transport the medium to the image forming section is provided in the swinging member, each of the pair of rollers is not separated from the other of the pair when the swinging member is opened. Consequently, the pressure between the pair of rollers is not changed over years so that the medium is transported in a stable condition.

When the swinging member is opened, the detent torque of the motor prevents the rotation of the swinging member by its own weight. When the swinging member is closed, it is closed smoothly because no detent torque of the motor is provided.

What is claimed is:

1. An image forming apparatus comprising;

a main body including a medium feed section for feeding a medium and an image forming section for forming an image on said medium;

a swinging member provided on said main body such that said swinging member can swing freely; and a feeding member rotatably supported by said swinging member and feeding said medium supplied from said medium feed section to said image forming section;

said swinging member being separable from said main body at a point where said medium is fed into said image forming section by said feeding member; and said swinging member being provided with a medium detection section for detecting said medium fed from said medium feed section.

2. The image forming apparatus according to claim 1, wherein said feeding member is composed of at least one pair of rollers.

3. The image forming apparatus according to claim 2, which further comprises a lock mechanism for locking said swinging member to said main body.

4. The image forming apparatus according to claim 2, wherein said swinging member and said main body include positioning elements, respectively, for positioning said swinging member with respect to said main body.

5. The image forming apparatus according to claim 4, wherein said positioning elements are provided in the vicinity of a supporting member for rotatably supporting said pair of rollers.

6. The image forming apparatus according to claim 2, wherein said one pair of rollers are provided to correct skew of said medium.

7. The image forming apparatus according to claim 2, wherein said main body is provided with a grounding plate;

said one pair of rollers are provided with a metal shaft which comes into contact with said grounding plate when said swinging member engages with said main body.

8. The image forming apparatus according to claim 1, which further comprises a belt unit for transporting said medium fed by said feeding member, said belt unit being provided such that said belt unit can be taken out in a direction in which said swinging member is opened with respect to said main body.

9. The image forming apparatus according to claim 8, wherein said belt unit comprises a transferring member.

10. The image forming apparatus according to claim 1, wherein said swinging member is provided with a plurality of medium feeding ports.

11. An image forming apparatus comprising:

a main body including a medium feed section for feeding a medium and an image forming section for forming an image on said medium;

a swinging member provided on said main body such that said swinging member can swing freely;

a feeding member rotatably supported by said swinging member and feeding said medium from said medium feed section to said image forming section; and a motor which is engaged with and disengaged from said swinging member, said motor being engaged with said swinging member when said swinging member is opened with respect to said main body.

12. The image forming apparatus according to claim 11, wherein said motor is disengaged from said swinging member when said swinging member is closed with respect to said main body.

13. A medium feed device comprising:

a main body;

an image processing section provided in said main body; and a swinging member provided on said main body such that said swinging member can swing freely; and a feeding member rotatably supported by said swinging member and feeding said medium supplied from a medium feed section to said image processing section;

said swinging member being separable from said main body at a point where said medium is fed to said image forming section; and said swinging member being provided with a medium detection section for detecting said medium fed by said medium feed section.

14. The medium feed device according to claim 13, wherein said feeding member is composed of at least one pair of rollers.

15. The medium feed device according to claim 14, which further comprises a lock mechanism for locking said swinging member to said main body.

16. The medium feed device according to claim 14, wherein said swinging member and said main body include positioning elements, respectively, for positioning said swinging member with respect to said main body.

17. The medium feed device according to claim 16, wherein said positioning elements are provided in the vicinity of a supporting member for rotatably supporting said pair of rollers.

18. The medium feed device according to claim 14, wherein said one pair of rollers are provided to correct skew of said medium.

19. The medium feed device according to claim 14, wherein said main body is provided with a grounding plate and said one pair of rollers are provided with a metal shaft which comes into contact with said grounding plate when said swinging member engages with said main body.

20. The medium feed device according to claim 13, wherein said swinging member is provided with a plurality of medium feeding ports.

21. A medium feed device comprising, a main body;

an image processing section provided in said main body;

a swinging member provided on said main body such that said swinging member can swing freely; and a feeding member rotatably supported by said swinging member and feeding said medium supplied from a medium feed section to said image processing section; and a motor which is engaged with and disengaged from said swinging member, said motor being engaged with said swinging member when said swinging member is opened with respect to said main body.

22. The medium feed device according to claim 21, wherein said motor is disengaged from said swinging member when said swinging member is closed with respect to said main body.

* * * * *